US011512925B1

(12) United States Patent
Pineda

(10) Patent No.: US 11,512,925 B1
(45) Date of Patent: Nov. 29, 2022

(54) FEEDER COVER FOR PAINTBALL LOADER

(71) Applicant: HK Army Inc., Signal Hill, CA (US)

(72) Inventor: Jason Jeremiah Pineda, Signal Hill, CA (US)

(73) Assignee: HK Army Inc., Signal Hill, CA (US)

( * ) Notice: Subject to any disclaimer, the term of this patent is extended or adjusted under 35 U.S.C. 154(b) by 0 days.

(21) Appl. No.: 17/653,344

(22) Filed: Mar. 3, 2022

(51) Int. Cl.
*F41B 11/52* (2013.01)

(52) U.S. Cl.
CPC ..... *F41B 11/52* (2013.01)

(58) Field of Classification Search
CPC ..... F41B 11/50; F41B 11/52; F41B 11/70
USPC ..... 124/45, 49, 50, 51.1
See application file for complete search history.

(56) References Cited

U.S. PATENT DOCUMENTS 6,015,058 A * 1/2000 Parks ..... F41B 11/52 220/345.2
6,234,157 B1 * 5/2001 Parks ..... F41B 11/52 124/45
6,722,355 B1 * 4/2004 Andrews, Jr. ..... F41B 11/52 124/49
7,011,083 B2 * 3/2006 Ho ..... F41B 11/52 124/45
7,077,118 B2 * 7/2006 Lewis ..... F41B 11/50 124/45
7,191,773 B2 * 3/2007 Vincent ..... F41B 11/52 141/331
7,216,641 B2 * 5/2007 Friesen ..... F41B 11/52 124/45
7,431,026 B2 * 10/2008 Ho ..... F41B 11/52 124/49
8,047,190 B2 * 11/2011 Kaakkola ..... F41B 11/57 124/1
D679,341 S * 4/2013 Riley ..... F41B 11/52 D21/573
D682,364 S * 5/2013 Riley ..... F41A 9/83 D21/573
D728,698 S * 5/2015 Evans ..... F41B 11/52 D21/573
D730,998 S * 6/2015 Evans ..... F41B 11/50 D21/573
9,163,899 B2 * 10/2015 Evans ..... F41B 11/70
9,651,334 B2 * 5/2017 Evans ..... F41B 11/52
9,658,027 B2 * 5/2017 Stevens ..... F41B 11/51
(Continued)

OTHER PUBLICATIONS

R2 Quick Feed—Cyan product page, https://shop.dyepaintball.com/products/rotor-r2-quick-feed-cyan, accessed on Jan. 4, 2022.

*Primary Examiner* — Alexander R Niconovich
(74) *Attorney, Agent, or Firm* — Knobbe, Martens, Olson & Bear, LLP

(57) ABSTRACT

A feeder cover for a paintball loader with fins that allow paintballs to enter, but not exit, the paintball loader. The feeder cover can easily clip in and out of a spring-loaded hinge of the paintball loader. Additionally, the feeder cover has an open and closed position. When the feeder cover is in the closed position, the feeder cover covers an opening of the paintball loader. The feeder cover has an opening that is partially blocked by fins. The fins of the feeder cover may have spring-loaded hinges that allow the fins to go from a closed position to an open position. Paintballs traveling into the paintball loader may push the fins from the closed position to the open position. The fins are individually removable and replaceable.

18 Claims, 15 Drawing Sheets

(56) References Cited

U.S. PATENT DOCUMENTS

| | | | | |
|---|---|---|---|---|
| 9,772,159 | B2 * | 9/2017 | Isabelle | F41B 11/52 |
| 10,876,810 | B1 * | 12/2020 | Pineda | F41A 9/82 |
| 2002/0059927 | A1 * | 5/2002 | Woods, Sr. | F41B 11/50 124/45 |
| 2007/0295319 | A1 * | 12/2007 | Carter | F41A 9/83 124/49 |
| 2009/0229589 | A1 * | 9/2009 | Karnis | F41B 11/52 124/45 |
| 2009/0283082 | A1 * | 11/2009 | Newman | F41B 11/52 220/229 |
| 2012/0103316 | A1 | 5/2012 | Kaakkola et al. | |
| 2014/0174422 | A1 * | 6/2014 | Evans | F41B 11/70 124/80 |
| 2016/0040954 | A1 * | 2/2016 | Evans | F41B 11/70 124/80 |

* cited by examiner

FEEDER COVER FOR PAINTBALL LOADER

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a feeder cover for a paintball loader, and more particularly to a feeder cover that has removable fins and that is removably connected to a hinge on a paintball loader.

Description of Related Art

Paintball is a fast-paced and competitive sport in which players use air-powered guns to fire paintballs at each other. Paintball can be played both indoors and outdoors with teams of varying sizes. In some matches, every player attempts to eliminate every other player. However, in other game styles, players work together as teams to eliminate players on different teams. Regardless of the game style, paintball players rely heavily on their equipment. For example, a player should perform regular maintenance on their paintball gun to minimize misfires and gun jams. Players also use a variety of consumables during matches, such as compressed $CO_2$ and paintballs. During a match, players should be careful to not run out of compressed gas or paintballs. The player's paintballs are generally stored in a paintball gun's loader which can hold about 100-500 paintballs. In some matches, players carry additional paintballs to refill their loaders during a match. However, refilling during a match may leave a player vulnerable to enemy fire and unable to support teammates. Additionally, players may need to quickly refill their loaders if they have back-to-back matches. Thus, it is important for players to be able to refill their loaders quickly and effectively.

SUMMARY

In accordance with one aspect of the disclosure, a feeder cover for a paintball loader is provided. The feeder cover includes an annular housing having a central opening centered on a central axis of the annular housing. Additionally, the annular housing configured to be removably coupled to the paintball loader. The annular housing includes a releasable latch configured to latch the housing to the paintball loader. The feeder cover also includes a plurality of fins removably coupled to the annular housing, each of the fins having a fin blade configured to at least partially extend into the central opening in a direction generally transverse to the central axis and cover at least a portion of the central opening. The fins include a spring-loaded hinge configured to allow the fin blades to move relative to the annular housing to allow paintballs traveling in a first direction to pass through the central opening of the annular housing and into the paintball loader and configured to inhibit paintballs traveling in a second direction opposite the first direction from passing through the central opening and out of the paintball loader.

In accordance with one aspect of the disclosure, the spring-loaded hinge includes a coil spring. In accordance with another aspect of the disclosure, the spring-loaded hinge allows movement of the fin blades relative to a proximal portion of the fins. Additionally, in some aspects, the annular housing includes a first annular portion and a second annular portion. The first and the second annular portions being coupleable to each other and together forming the annular housing, wherein a proximal portion of the fins is interposed between the first and second annular portions. In accordance with one aspect of the disclosure, the first and second annular portions together define slots that receive the proximal portions of the fins. In accordance with another aspect of the disclosure, the fins are made of aluminum. Additionally, in some aspects, the plurality of fins is five fins.

In accordance with one aspect of the disclosure, the fin blades have openings that allow air to pass therethrough. In accordance with another aspect of the disclosure, the fin blades have a stepped outer edge portion so that a gap between adjacent fin blades is smaller proximate an inner surface of the annular housing than proximate the central axis, which facilitates loading of paintballs into the loader when traveling in the first direction while inhibiting paintballs travelling in the second direction from falling out of the paintball loader. Additionally, in some aspects, the releasable latch of the feeder cover is configured to be received in a slot of the paintball loader. In accordance with one aspect of the disclosure, the annular housing is configured to be removably coupled to the paintball loader via a hinge mechanism.

In accordance with one aspect of the disclosure, an assembly for storing paintballs is provided. The assembly includes a paintball loader and a feeder cover configured to be removably coupled to the paintball loader. The feeder cover includes an annular housing having a central opening centered on a central axis of the annular housing. The annular housing configured to be removably coupled to a hinge mechanism of the paintball loader. The annular housing includes a front release configured to couple to the paintball loader and allow the annular housing to pivot relative to the paintball loader. The feeder cover also includes a plurality of fins removably coupled to the annular housing, each of the fins having a fin blade configured to at least partially extend into the central opening in a direction generally transverse to the central axis and cover at least a portion of the central opening. The fins include a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader. Additionally, the paintball loader configured to receive and store paintballs passing through the feeder cover.

In accordance with one aspect of the disclosure, a feeder cover kit for a paintball loader is provided. The feeder cover kit includes a feeder cover. The feeder cover includes an annular housing having a central opening centered on a central axis of the annular housing. The annular housing configured to be removably coupled to the paintball loader. The annular housing includes a releasable latch configured to latch the housing to the paintball loader. The feeder cover also includes a plurality of fins removably coupled to the annular housing, each of the fins having a fin blade configured to at least partially extend into the central opening in a direction generally transverse to the central axis and cover at least a portion of the central opening. The fins include a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader. The kit includes one or more replacement fins that are configured to be removably coupled to the annular housing to replace one or more fins attached to the annular housing.

DETAILED DESCRIPTION

Figure 1:
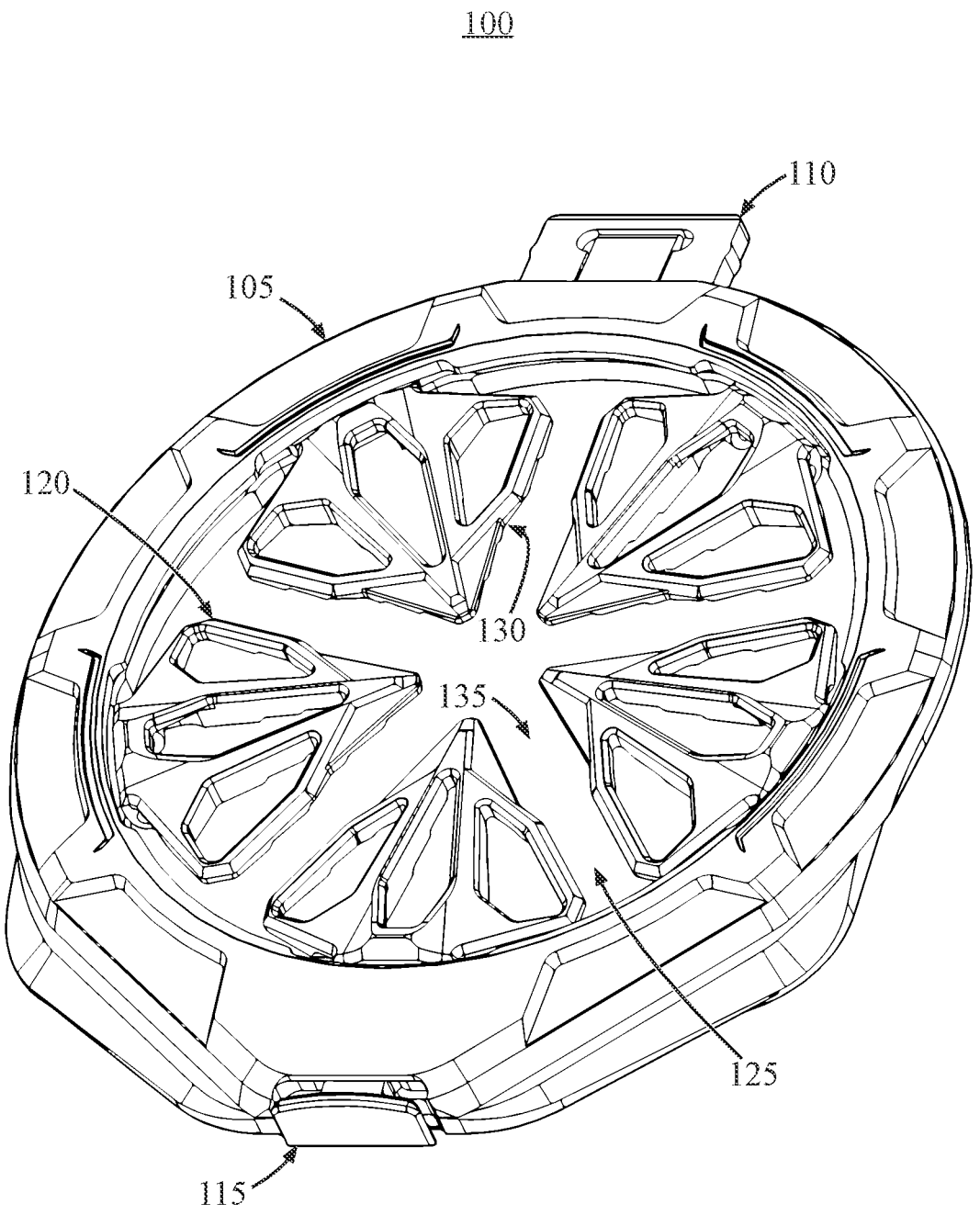
FIG. 1 illustrates a perspective view of a feeder cover for a paintball loader.
Figure 2:
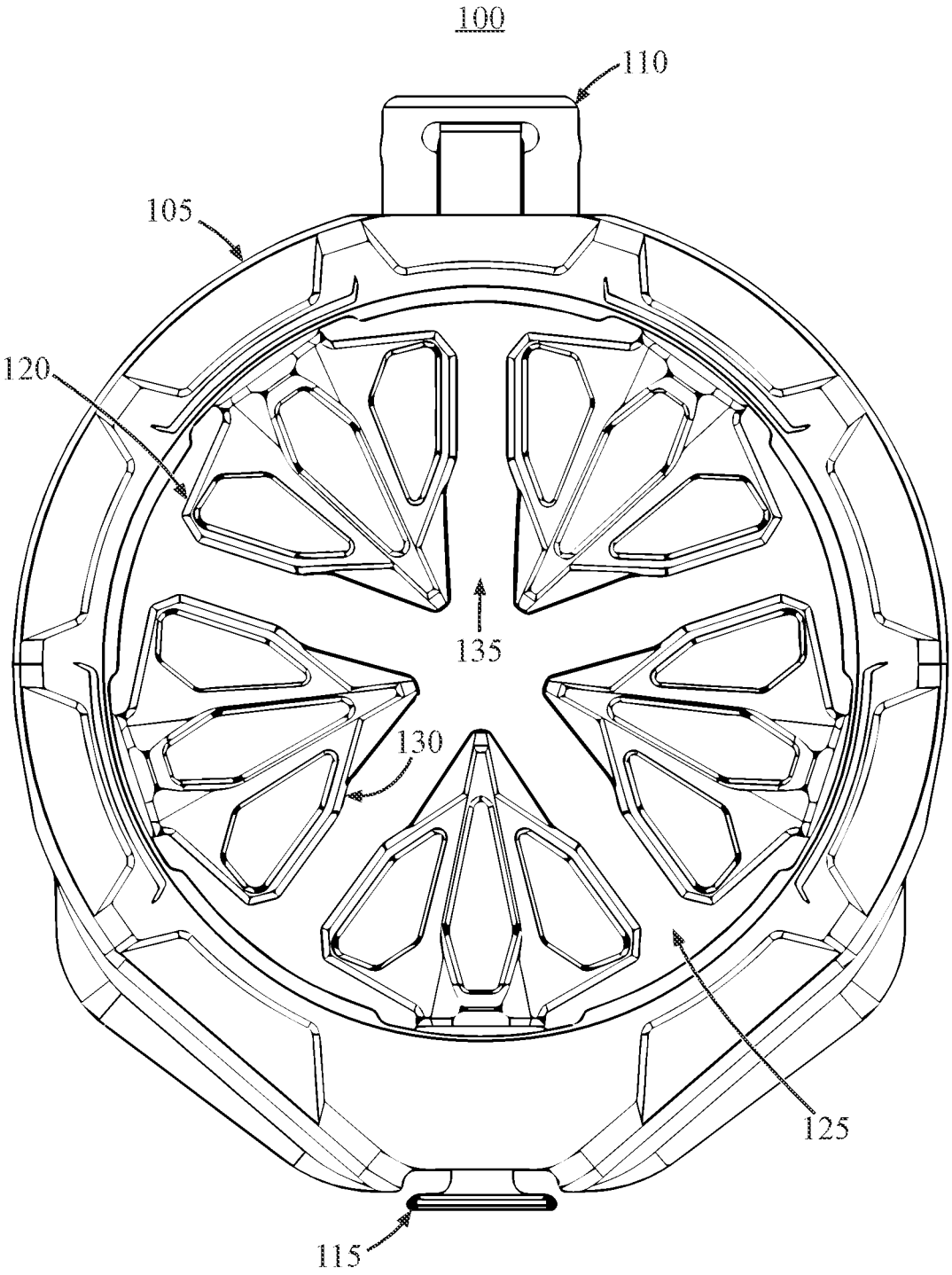
FIG. 2 illustrates a top view of the feeder cover of FIG. 1, with the fins in the closed position.
Figure 3:
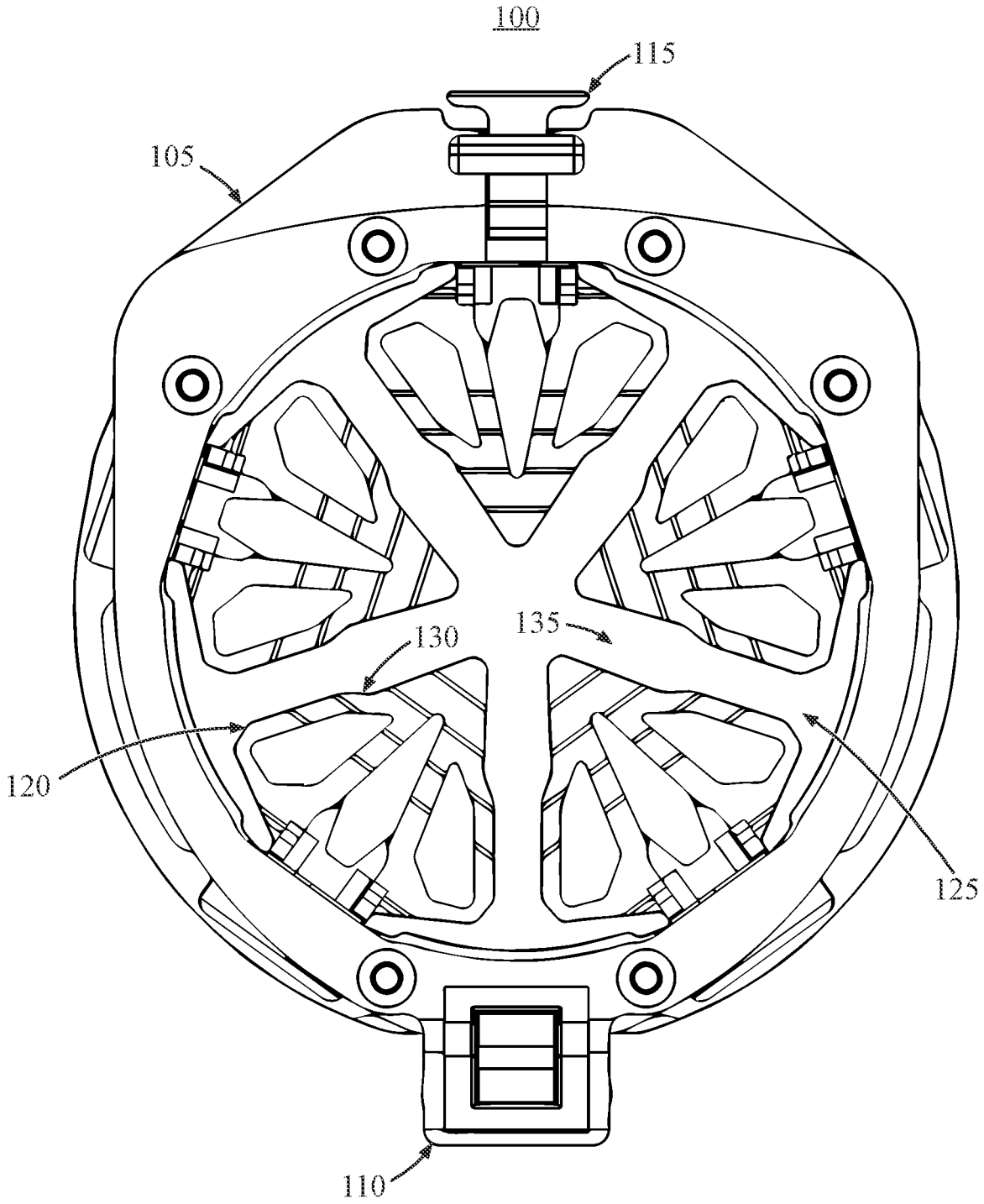
FIG. 3 illustrates a bottom view of the feeder cover of FIG. 1.
Figure 4:
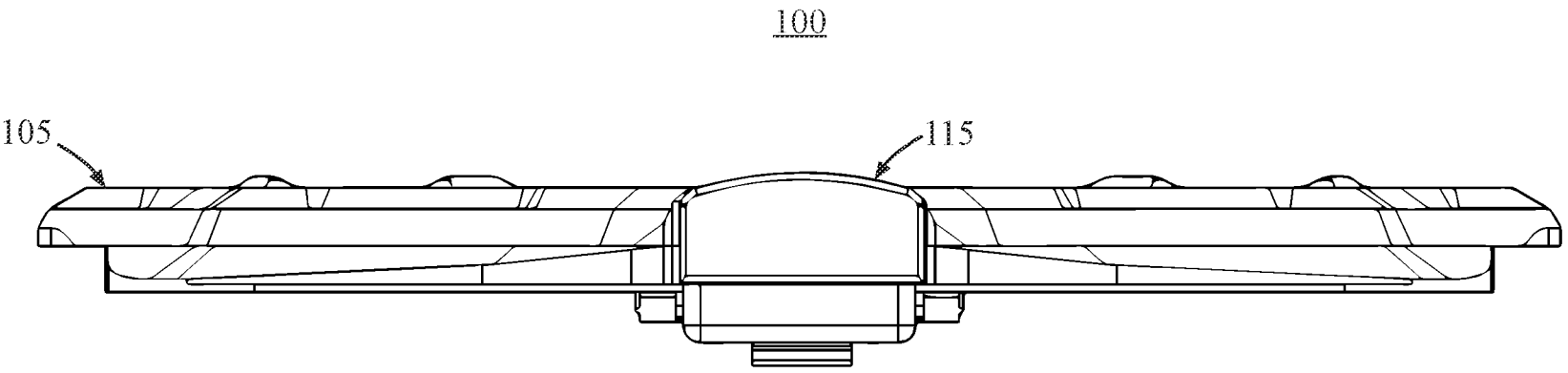
FIG. 4 illustrates a front view of the feeder cover of FIG. 1.
Figure 5:
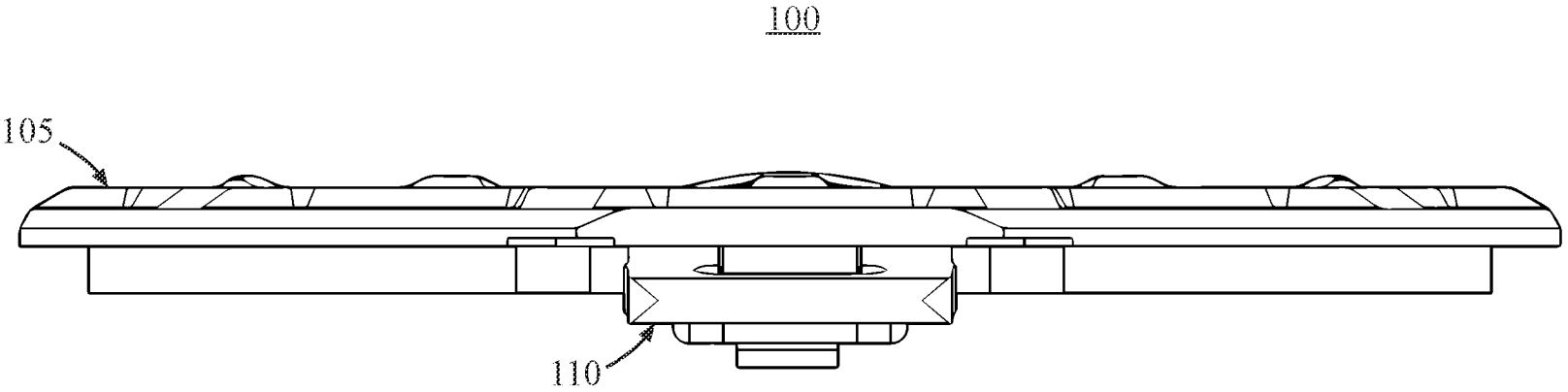
FIG. 5 illustrates a rear view of the feeder cover of FIG. 1.

The present disclosure describes various implementations of a feeder cover for a paintball loader. The feeder cover attaches to a hinge of the paintball loader. The feeder cover has an annular housing and five fins that have a closed position and an open position. In the closed position, the five fins extend towards each other and over a central opening of the annular housing. In other words, the five fins partially block the central opening. By partially blocking the central opening, the fins prevent paintballs from falling out of the paintball loader. The paintballs will remain in the loader even when the paintball loader is jostled or held upside down. Thus, a user can participate in paintball matches without having to worry about spilling the loader's paintballs.

Additionally, each fin has a spring-loaded hinge that allows the fins to move (e.g., independently of each other) so that the paintball loader can be easily and quickly refilled. More specifically, when a user pours paintballs into the feeder cover, the paintballs push the fins from the closed position to the open position. In the open position, the fins do not cover or block (or cover less or block less of) the central opening of the annular housing. In other words, the fins are generally perpendicular relative to the central opening (e.g., transverse to a plane defined by the central opening) while in the open position. Thus, the user does not need to take any additional steps to refill the loader beyond pouring the paintballs (e.g., from a paintball tube, pod, or bag) into the central opening of the feeder cover. For example, a user does not need to remove or open the feeder cover before refilling his or her loader. Advantageously, the feeder cover allows users to refill their paintball loaders without having to set down their paintball guns. For instance, the user can hold his or her paintball gun with one hand while pouring the paintballs into the feeder cover with another hand. This is especially useful when the user is refilling during a paintball match (e.g., refilling while simultaneously trying to avoid being hit by enemy players).

A user can also easily install the feeder cover to a compatible paintball loader. More specifically, in one implementation the feeder cover uses a snap-fit fastener to attach to the hinge of the paintball loader. The snap-fit fastener allows the feeder cover to be easily removed or exchanged for another feeder cover. Thus, a user can quickly replace a broken feeder cover or easily customize their paintball loader by exchanging feeder covers. The fins are also easily removed or exchanged. Thus, a user can quickly replace one or more broken fins instead of replacing the entire feeder cover.

FIGS. 1-5 illustrate a perspective, top, bottom, front, and rear view, respectively, of a feeder cover 100 for a paintball loader. The feeder cover 100 may be made of metal, such as aluminum or steel. Alternatively, or in addition, the feeder cover 100 may be made of plastic or a composite, such as carbon fiber. The feeder cover 100 has an annular housing 105, a back fastener 110, a front fastener 115, and one or more fins 120. The size of the feeder cover 100 may vary to accommodate different user's preferences and equipment. For example, the annular housing 105 may have an outer radius of 6 cm-15 cm, or larger than 15 cm. For instance, the annular housing 105 may have an outer radius of 10 cm. The annular housing 105 may have a central opening 125 centered on the central axis of the annular housing 105. The central axis is the axis that passes through the radial center of the annular housing 105. The size of the central opening 125 may vary to accommodate different user's preferences and equipment. More specifically, the central opening 125 may have a radius of 5 cm-12 cm, or larger than 12 cm. For example, the central opening may have a radius of 9 cm.

In some embodiments, the feeder cover 100 has five fins 120. Alternatively, the feeder cover 100 may have 1-10 fins 120 or more than 10 fins 120. The fins 120 may be made of metal, such as aluminum or steel. Alternatively, or in addition, the fins 120 may be made of plastic or a composite, such as carbon fiber. In some embodiments, the fins 120 are removably attached to the annular housing 105. For example, in some embodiments, the fins 120 are at least partly interposed between two separable portions of the annular housing 105. Alternatively, the fins 120 may be permanently coupled to the annular housing 105. When the fins 120 are in a closed position, shown in FIG. 1, the fins 120 may extend into the central opening 125 (e.g., extend generally transverse or perpendicular to a central axis through a center of the central opening 125) of the feeder cover 100. Additionally, the fins 120 may block at least a portion of (e.g., a majority of) the central opening 125 when in the closed position. Thus, the fins 120 advantageously inhibit (e.g., prevent) paintballs travelling in a second direction (e.g., from inside the paintball loader to outside the paintball loader) from passing through the central opening 125 (e.g., because when in the closed position, the gap 135 between the fins 120 is smaller than a diameter of a paintball and the fins 120 do not move away from the central opening). In some embodiments, the one or more fins 120 may allow paintballs travelling in a first direction (e.g., from outside the paintball loader to inside the paintball loader) to pass through the central opening 125. More specifically, the paintballs travelling in the first direction may push the fins 120 from the closed position to the open position. In the open position, the fins 120 may be transverse or generally perpendicular to the central opening 125. Thus, in the open position, the fins 120 do not block the central opening 125 or block less of the central opening 125 compared to the fins 120 in the closed position.

In some embodiments, the one or more fins 120 have stepped outer edges 130. The stepped outer edges 130 may cause a gap 135 between adjacent fins 120 to be smaller proximate to the inner surface of the annular housing 105 than proximate to the central axis of the annular housing 105. For example, the gap 135 between adjacent fins 120 may be larger at the tips of the fins 120 than at the base of the fins 120. The stepped outer edges 130 may allow paintballs travelling in the first direction to enter the paintball loader more easily while still preventing paintballs traveling in a second direction from exiting the paintball loader. More specifically, the stepped outer edges 130 allow paintballs travelling in the first direction to enter the paintball loader more easily. For example, paintballs travelling in the first direction may enter the loader even if the fins 120 are only partially in the open position (e.g., when the fins 120 are at about a 45° angle relative to the central opening 125). The stepped outer edges 130 may also reduce the weight of the feeder cover 100.

Figure 6:
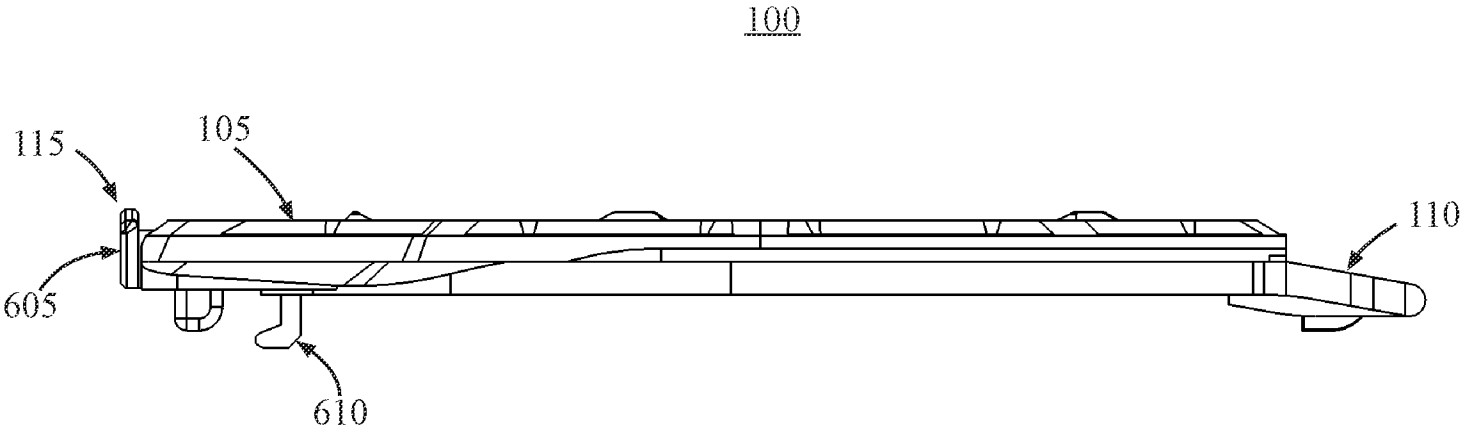
FIG. 6 illustrates a right view of the feeder cover of FIG. 1.
Figure 7:
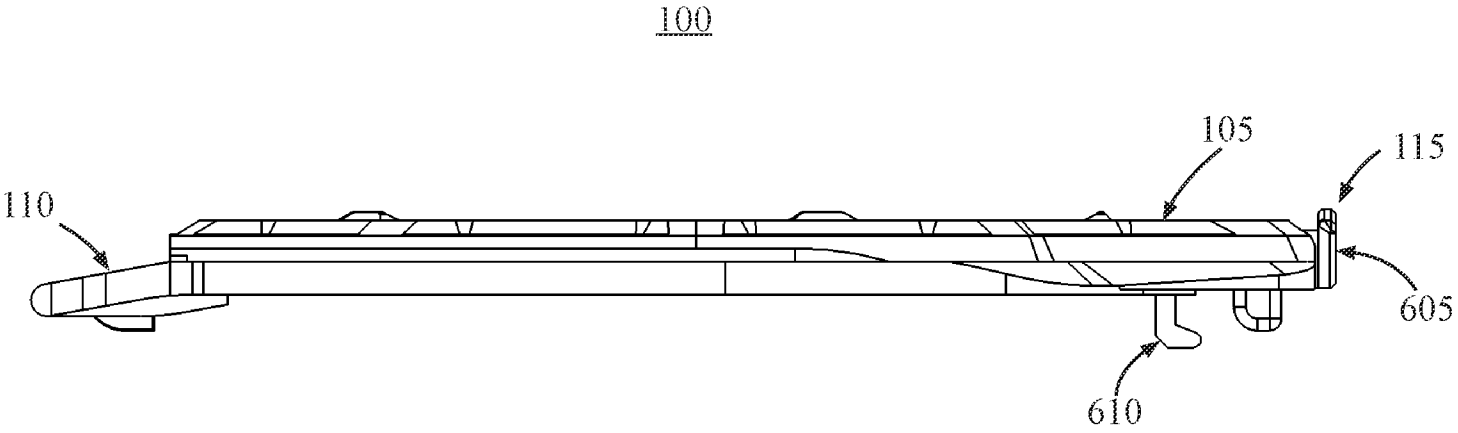
FIG. 7 illustrates a left view of the feeder cover of FIG. 1.

FIGS. 6 and 7 illustrate a right and left view of one embodiment of the feeder cover 100. In some embodiments, the back fastener 110 and/or the front fastener 115 are removably attached to the annular housing 105. For example, in some embodiments, the back fastener 110 and/or the front fastener 115 are partly enclosed between two separable portions of the annular housing 105. Alternatively, the back fastener 110 and/or front fastener 115 may be permanently attached to the annular housing 105. For example, the annular housing 105, the back fastener 110, and/or front fastener 115 may be a single component (e.g., cast from the same mold).

In some embodiments, the front fastener 115 has a release button 605 and a cantilever hook 610 (e.g., a snap-fit fastener). The cantilever hook 610 may be used to removably attach the front fastener 115 to a slot of the paintball loader via a snap-fit. The release button 605 may be used to push the cantilever hook 610 out of the slot of the paintball loader so that the front fastener may be detached from the paintball loader. It should be noted that other attachment methods can be used to attach the front fastener 115 to the paintball loader. For example, in some embodiments the front fastener 115 is a latch, screw, buckle, clamp, actuator, or clip that attaches to a corresponding attachment point on the paintball loader. Alternatively, or in addition, the front fastener 115 may use magnets, a friction fit, or hook and loop fasteners to attach to the paintball loader. The front fastener 115 may also use a combination of fastening methods (e.g., a snap-fit with a magnet).

Figure 8:
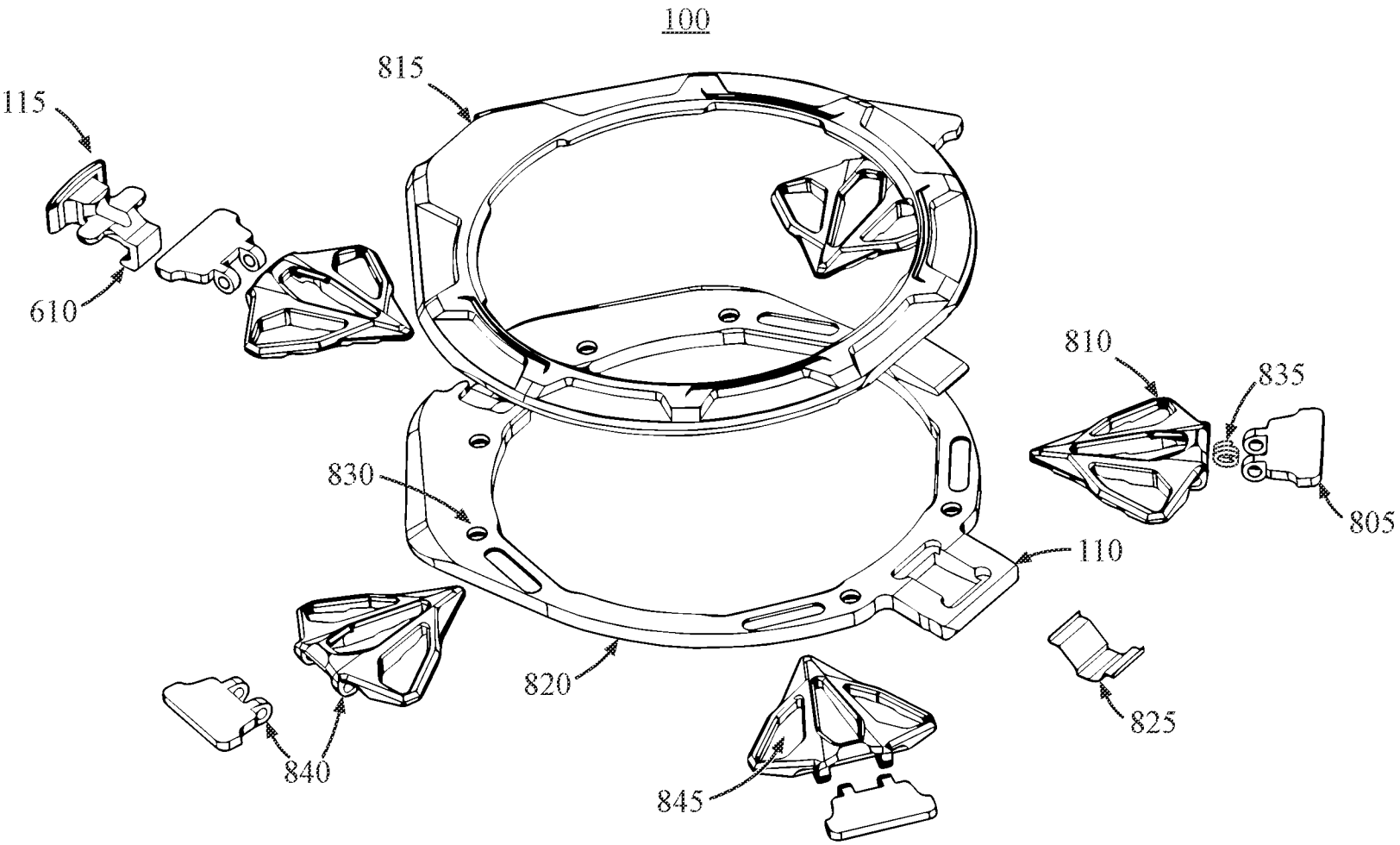
FIG. 8 illustrates a top exploded perspective view of the feeder cover of FIG. 1.

FIG. 8 illustrates a top exploded perspective view of the feeder cover 100. In some embodiments, the back fastener 110 is removably coupled to the paintball loader via a snap-fit mechanism. More specifically, the back fastener 110 may have a spring clip 825 that snaps into a cavity of the paintball loader. The user may push on the spring clip 825 to release the snap-fit and detach the back fastener 110 from the cavity of the paintball loader. It should be noted that other fastening methods can be used to attach the back fastener 110 to the paintball loader. For example, in some embodiments the back fastener 110 is a latch, screw, buckle, clamp, actuator, or clip that attaches to a corresponding attachment point on the paintball loader. Alternatively, or in addition, the back fastener 110 may use magnets or hook and loop fasteners to attach to the paintball loader. The back fastener 110 may also use a combination of fastening methods (e.g., a snap-fit with a magnet).

In some embodiments, the annular housing 105 has a first annular portion 815 and a second annular portion 820. The first annular portion 815 and/or second annular portion 820 may have one or more threaded holes 830. The one or more threaded holes 830 allow the first annular portion 815 and second annular portion 820 to be removably coupled via threaded screws. However, other fastening methods can be used to removably coupled the first annular portion 815 and second annular portion 820. For example, in some embodiments the first annular portion 815 and second annular portion 820 are fastened together via one or more snap-fit, latch, buckle, clamp, actuator, magnet, or clip fasteners, or key/slot mechanism. Alternatively, or in addition, the first annular portion 815 and second annular portion 820 may be fastened together using a friction fit. In some embodiments, a user may need a tool (e.g., screwdriver, small pry bar, etc.) to separate the first annular portion 815 and second annular portion 820. However, in other embodiments, the user can separate the first annular portion 815 and second annular portion 820 without any tools (e.g., with their hands).

In some embodiments, the one or more fins 120 have two or more parts. For example, the fins 120 may have fin blades 810, fin hinges 840, and proximal portions 805. A fin blade 810 may have one or more openings 845 that allow air to pass through the fin blade 810 (e.g., to facilitate movement of the fin blade 810 by providing less resistance than a solid blade, and by reducing the weight of the fin blade 810). In some embodiments, the fin blade 810 and the proximal portion 805 may be movably coupled via the fin hinge 840. The fin hinge 840 may allow the fin blade 810 to rotate relative to the proximal portion 805. In some embodiments, the fin hinge 840 is spring-loaded. For example, the fin hinge 840 may use a pin (e.g., a friction pin) and a coil spring 835 to movably couple the fin blade 810 and the proximal portion 805. Alternately, other hinge types and/or fastening methods can be used to movably couple the fin blade 810 and the proximal portion 805. For example, the fin blade 810 and the proximal portion 805 can be fastened together via one or more snap-fit, latch, buckle, clamp, actuator, magnet, or clip fasteners. Additionally, a combination of fastening methods may be used (e.g., a magnetic latch).

Figure 9:
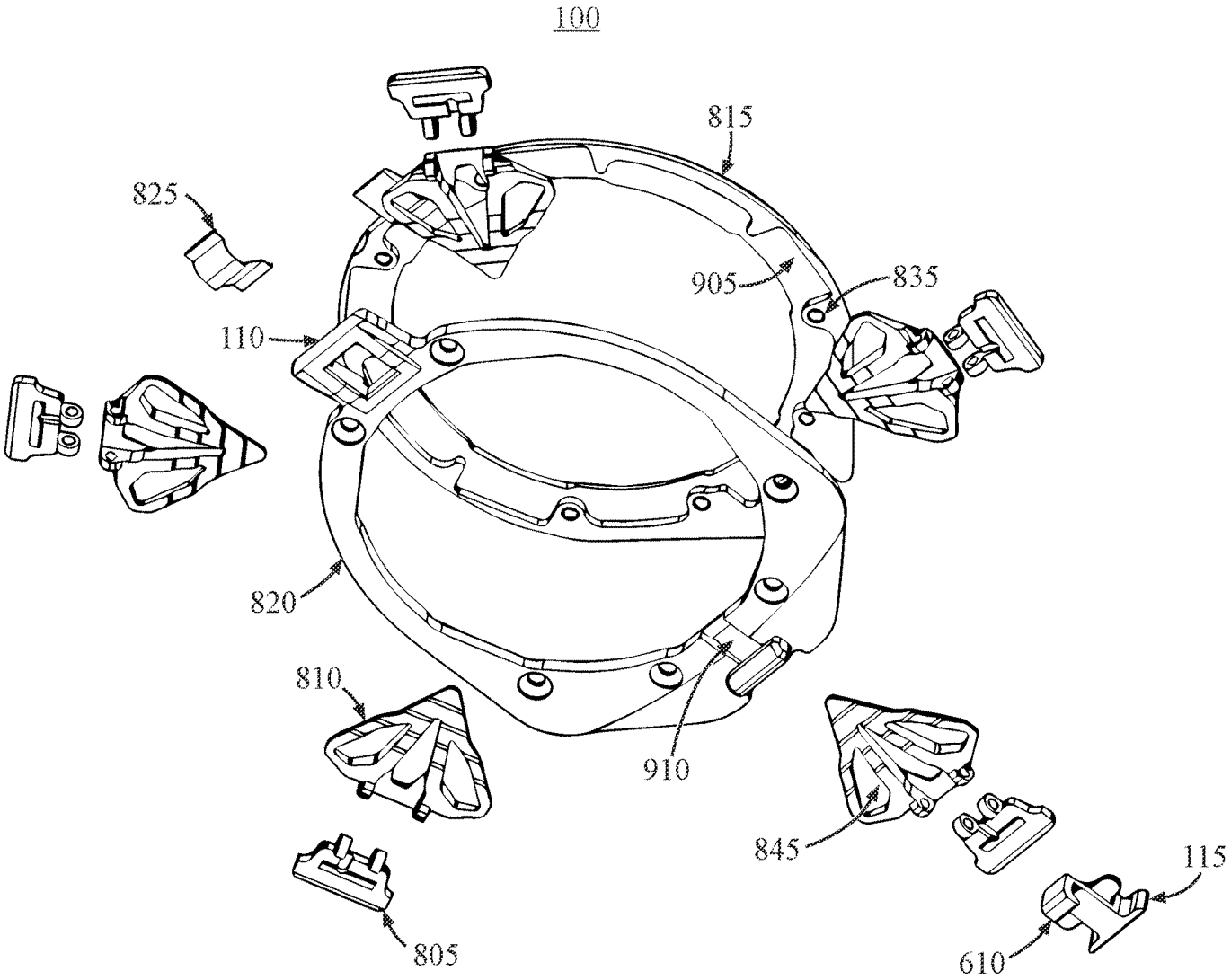
FIG. 9 illustrates a bottom exploded perspective view of the feeder cover of FIG. 1.

FIG. 9 illustrates a bottom exploded perspective view of the feeder cover 100. In some embodiments, the first annular portion 815 has one or more slots 905 to receive at least part of the proximal portions 805 of the fins 120. Alternatively, or in addition, the second annular portion 820 may have one or more slots 905 to receive at least part of the proximal portions 805 of the fins 120. For example, the slots 905 may be a pocket, recess or indentation in the first annular portion 815, the second annular portion 820, or both. A proximal portion 805 may be removably coupled to the annular housing 105 by being at least partially enclosed in the slot 905 between the first annular portion 815 and the second annular portion 820. Alternatively, the proximal portion 805 and the annular housing 105 can be fastened together via one or more latch, buckle, clamp, actuator, magnet, or clip fasteners. Additionally, a combination of fastening methods may be used to removably couple the proximal portion 805 and the annular housing 105.

In some embodiments, the back fastener 110 and/or the front fastener 115 may be removably coupled to the annular housing 105 by being at least partially enclosed in the slot 905. Additionally, a single slot 905 can enclose the front fastener 115 and the proximal portion 805 of the fin 120. Alternatively, or in addition, the slot 905 may have a hole 910 that allows the cantilever hook 610 to pass through the second annular portion 820 when the front fastener 115 is at least partially enclosed by the annular housing 105.

In some embodiments, a user may remove or replace one or more fins 120 by separating the first annular portion 815 and the second annular portion 820. In other embodiments, a user may remove or replace one or more fins 120 without separating the first annular portion 815 and the second annular portion 820. For example, the proximal portion 805 may be removably coupled to the annular housing 105 via a snap-fit or friction fit. For instance, a user may slide the proximal portion 805 into the slot 905 of a non-separated annular housing 105 until it reaches a snap-in area (e.g., a cantilever clip on the proximal portion 805 reaches a corresponding gap in the slot 905). Additionally, without separating the annular housing 105, the user may be able to push a button or lever to release the snap-fit fastener to remove the proximal portion 805 from the slot 905. Alternatively, a user may slide the proximal portion 805 into the slot 905 of a non-separated annular housing 105 and use a screw or pin to hold the fin 120 in place. Thus, in some embodiments, a user may remove a fin by removing the screw or pin, instead of having to separate the annular housing 105.

As mentioned above, the fins 120 have a closed position and an open position. FIGS. 8 and 9 illustrate the exploded fins 120 in the closed position. In the closed position, the fin blade 810 and the proximal portion 805 may be parallel to each other (or generally extend along the same plane). The fin blade 810 may be maintained in the closed position via the coil spring 835 in the fin hinge 840 (e.g., the coil spring 835 biases the fin blade 810 toward the closed position). In some embodiments, the fin blades 810 can be opened by one or more paintballs travelling in the first direction (e.g., into the loader). For example, one or more falling paintballs may push the fin blades 810 from the closed position to an open or partially open position (e.g., somewhere in-between the closed position and the open position). It should be noted that paintballs travelling in the first direction may enter the loader when the fin blades 810 are in a partially open position. In some embodiments, one or more paintballs may not provide enough force to push the fin blades 810 from the closed position to the open position. For example, the user may need to partially insert a paintball tube into the fin blades 810 to move the fin blades 810 to the open position (e.g., the lip of the paintball tube pushes the fin blades 810 to the open position to allow the paintballs to enter the loader). It should be noted that the fin hinges 840 do not allow paintballs traveling in a second direction (e.g., out of the loader) to push the fin blades 810 to another position. More specifically, the fin hinges 840 may not allow the fin blades 810 to point up and out of the loader, thereby inhibiting (e.g., preventing) paintballs to exit the loader through the feeder cover 100.

Figure 10:
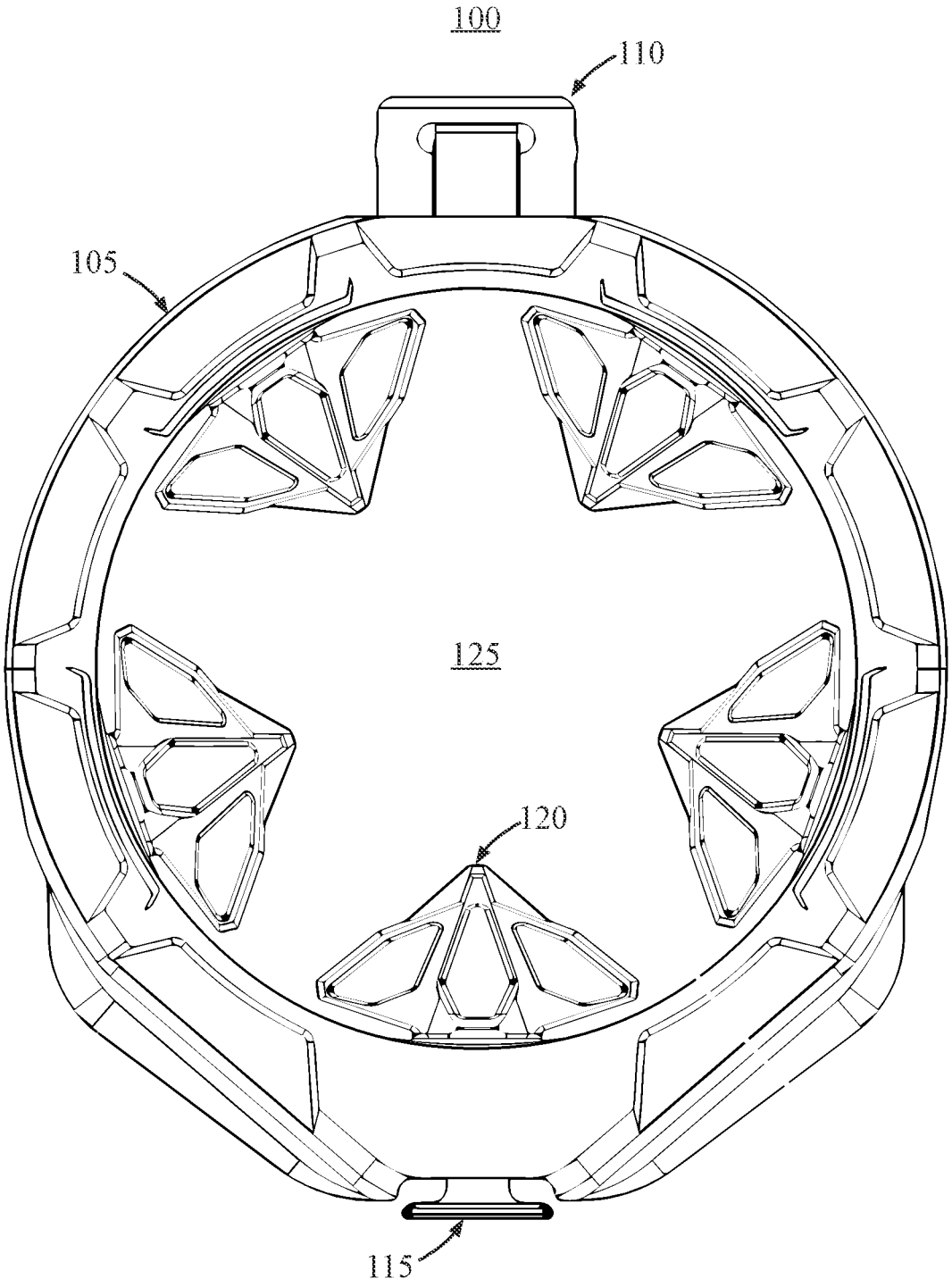
FIG. 10 illustrates a top view of the feeder cover of FIG. 1 with the fins in the open position.
Figure 11:
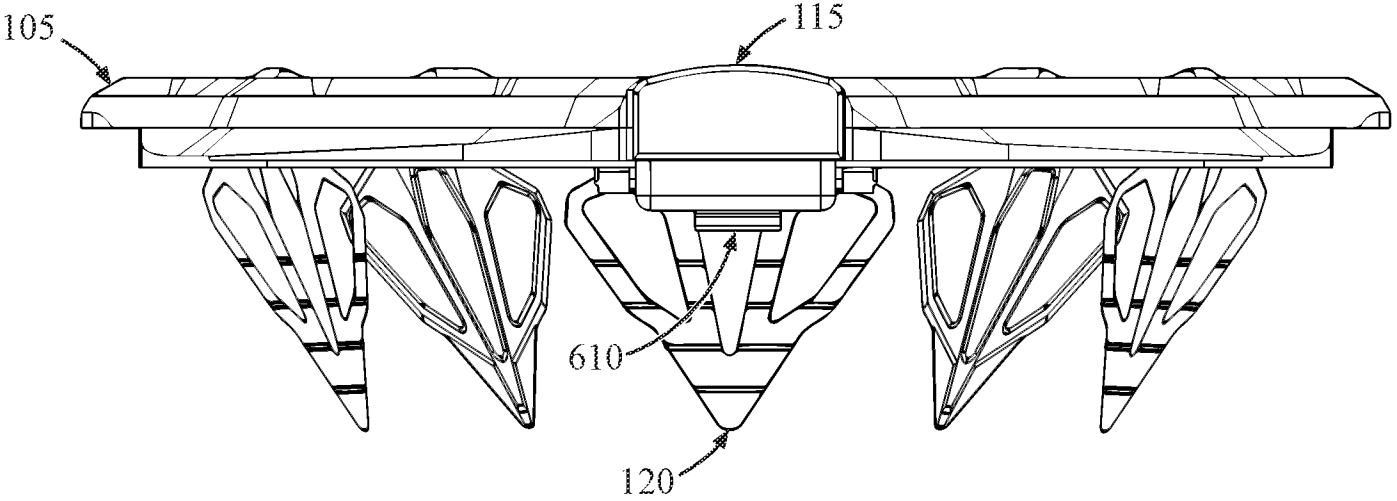
FIG. 11 illustrates a front view of the feeder cover of FIG. 1 with the fins in the open position.

FIGS. 10 and 11 illustrate a top view and front view, respectively, of the feeder cover 100 when the fin blades 810 are in the open position. In the open position, the fin blades 810 may block much less of the central opening 125 as compared to the fin blades 810 in the closed position. In some embodiments, the fin blades 810 in the open position do not block any of the central opening 125 (e.g., the fin blades 810 are perpendicular to the central opening 125). However, in other embodiments, the fin blades 810 are not perpendicular to the central opening 125 in the open position. Instead, the fin blades 810 are at an angle of 30°-89°, such as 80°, with respect to the central opening 125.

Figure 12:
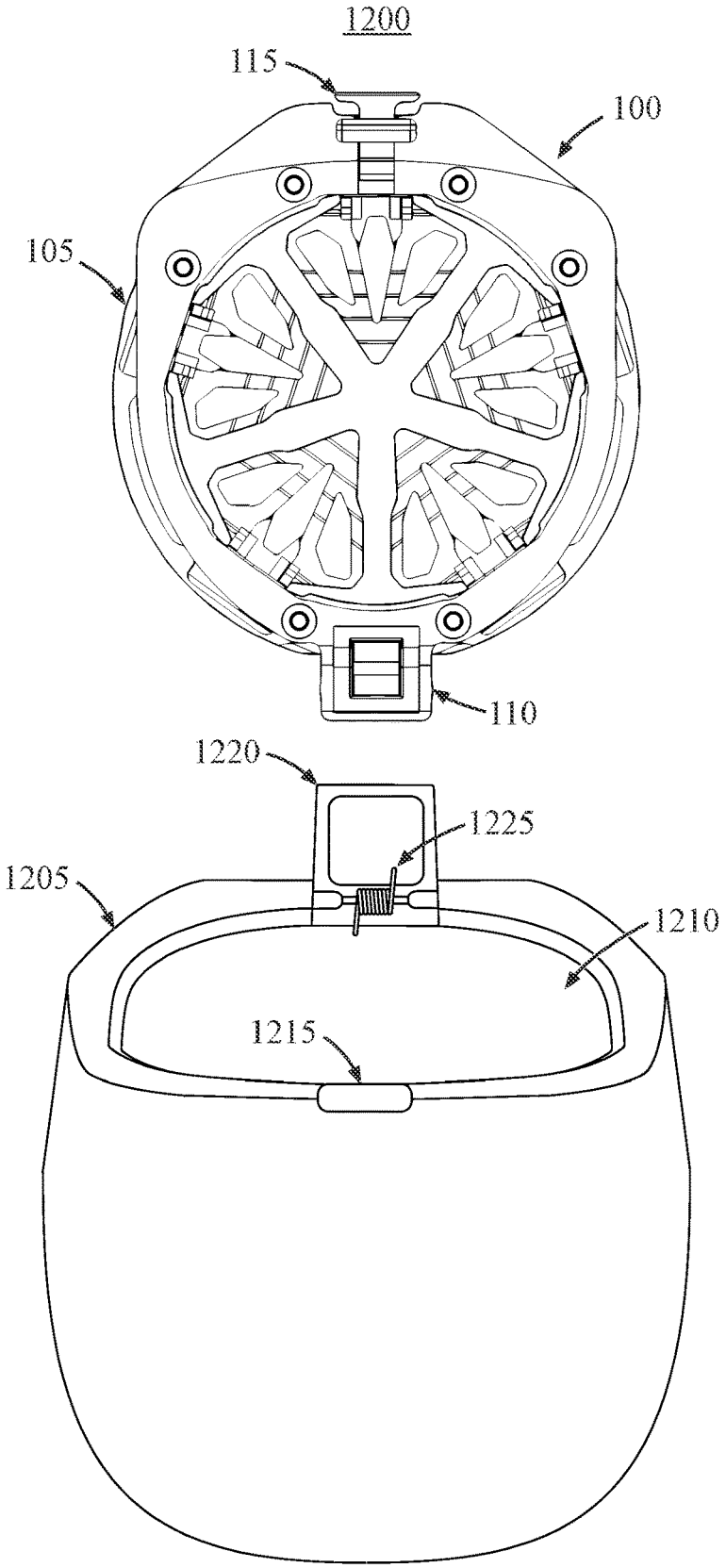
FIG. 12 illustrates a back view of an assembly for storing paintballs where the feeder cover of FIG. 1 is detached from the loader.

FIG. 12 illustrates a back view of an assembly 1200 for storing paintballs that includes the feeder cover 100 and the loader 1205. Additionally, in FIG. 12, the feeder cover 100 is detached from the loader 1205. In some cases, a user may detach the feeder cover 100 to clean, store, or repair the feeder cover. The capacity of the loader 1205 may vary to accommodate different user's preferences and equipment. For example, the loader 1205 may have a capacity of 100-400 paintballs, such as a capacity of 200 paintballs. In some embodiments, the loader 1205 may have an opening 1210, a slot 1215, and a loader hinge 1220. The opening 1210 can be used to fill the loader 1205 with paintballs. Additionally, the opening 1210 can be used to empty the loader 1205. For example, a user may empty the loader of unused paintballs after a paintball match. The size of the opening 1210 may vary to accommodate different user's preferences and equipment. For example, the opening 1210 may have a radius of 6 cm-15 cm, or larger than 15 cm. For instance, the opening 1210 may have a radius of 9 cm. In some embodiments, the loader 1205 may have a slot 1215. As described above, the front fastener 115 may attach to the loader 1205 via the slot 1215. More specifically, the cantilever hook 610 of the front fastener 115 may attach to the slot 1215 via a snap fit.

Figure 13:
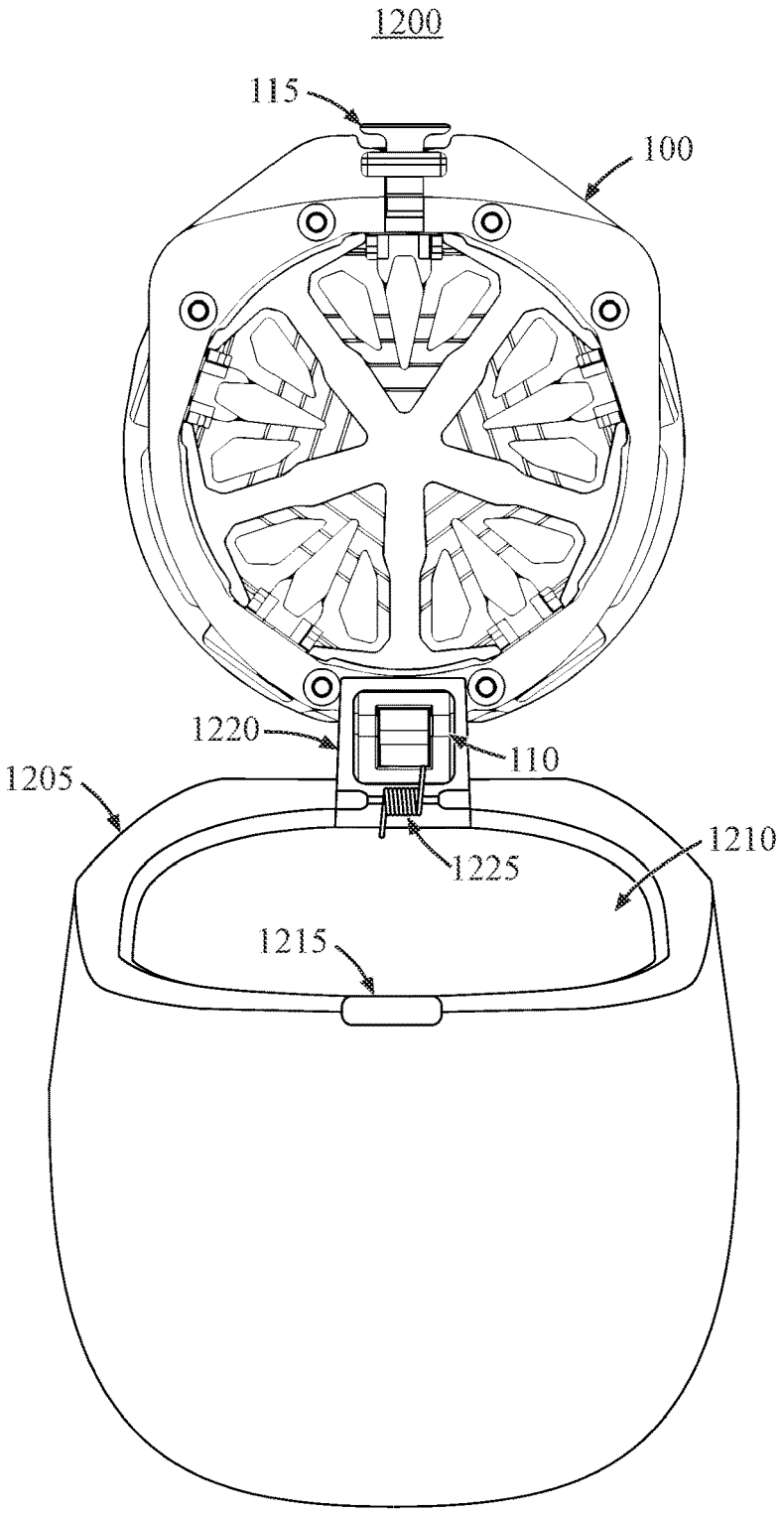
FIG. 13 illustrates a back view of an assembly for storing paintballs where the feeder cover of FIG. 1 is attached to the loader and in the open position.

FIG. 13 illustrates a back view of the assembly 1200 where the feeder cover 100 is attached to the loader 1205 and in the open position (e.g., the loader hinge 1220 and the feeder cover 100 are generally perpendicular to the opening 1210). In some embodiments, the feeder cover 100 can be removably coupled to the loader 1205 via the loader hinge 1220. As described above, the back fastener 110 may have a spring clip 825 that clips into a cavity of the loader hinge 1220. The loader hinge 1220 may be spring-loaded (e.g., with a coil spring 1225) and biased towards the open position. For example, the loader hinge 1220 may spring to the open position when the front fastener 115 is detached. In some embodiments, a user may put the feeder cover 100 in the open position by pressing the release button 605 of the front fastener 115. A user may put the feeder cover 100 in the open position to empty or clean the loader 1205. However, unlike traditional covers for loaders, the user does not need to put the loader hinge 1220 in the open position to fill the loader with paintballs.

Figure 14:
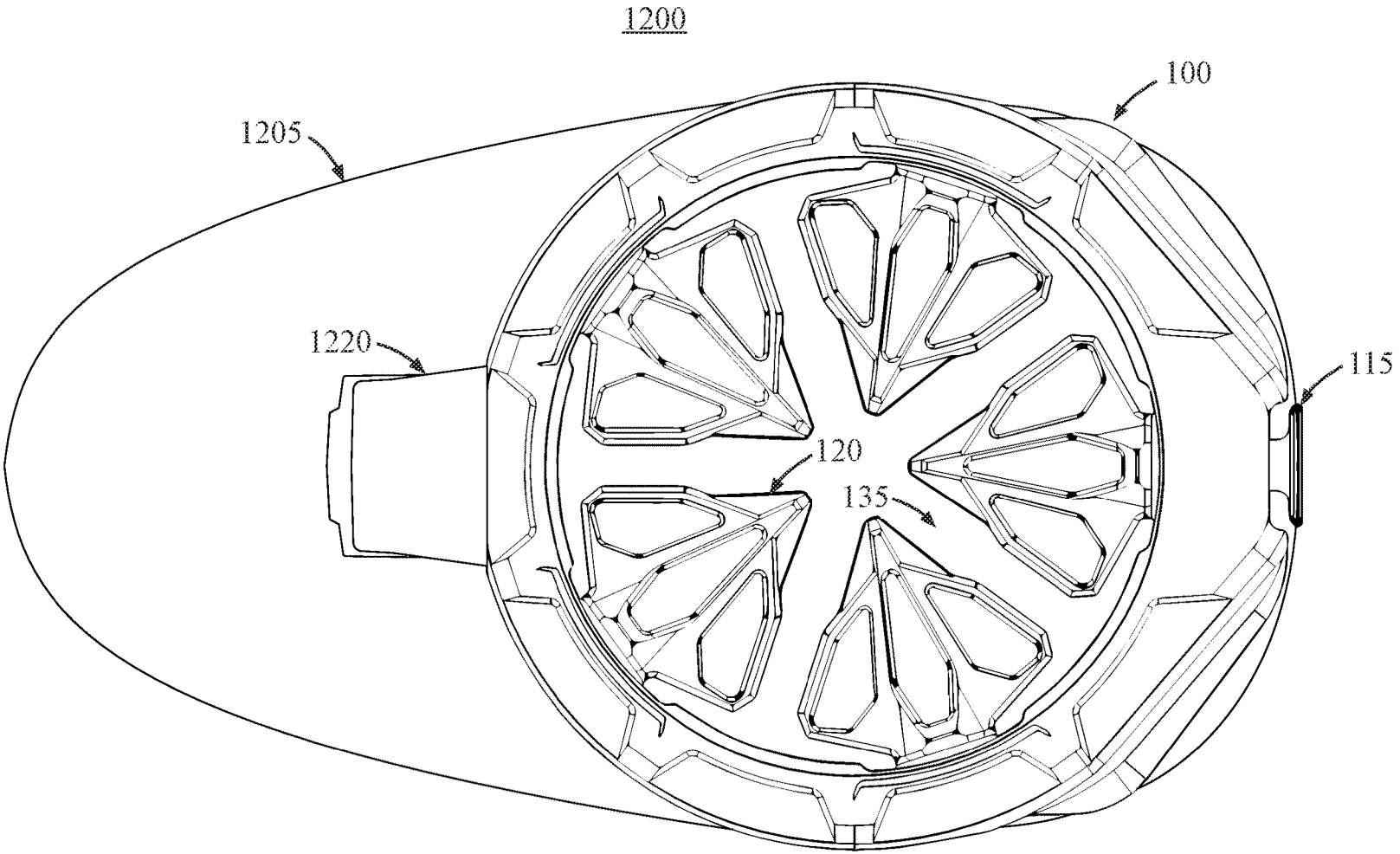
FIG. 14 illustrates a top view of an assembly for storing paintballs where the feeder cover of FIG. 1 is attached to the loader and in the closed position.

FIG. 14 illustrates a top view of the assembly 1200 where the feeder cover 100 is attached to the loader 1205 and in the closed position. When the feeder cover 100 is in the closed position, the feeder cover 100 is generally parallel to the opening 1210. Additionally, the feeder cover 100 covers the opening 1210. Thus, when the feeder cover 100 is in the closed position, no paintballs can exit the loader (e.g., the gaps 135 between the fins 120 are smaller than the radius of a paintball). As describe above, the feeder cover is held in the closed position by the front fastener 115. In some embodiments, the feeder cover 100 does not have a front fastener 115 or a back fastener 110. Instead, the annular housing 105 has threads and can be screwed onto corresponding threads on the lip of the opening 1210 of the loader 1205.

Figure 15:
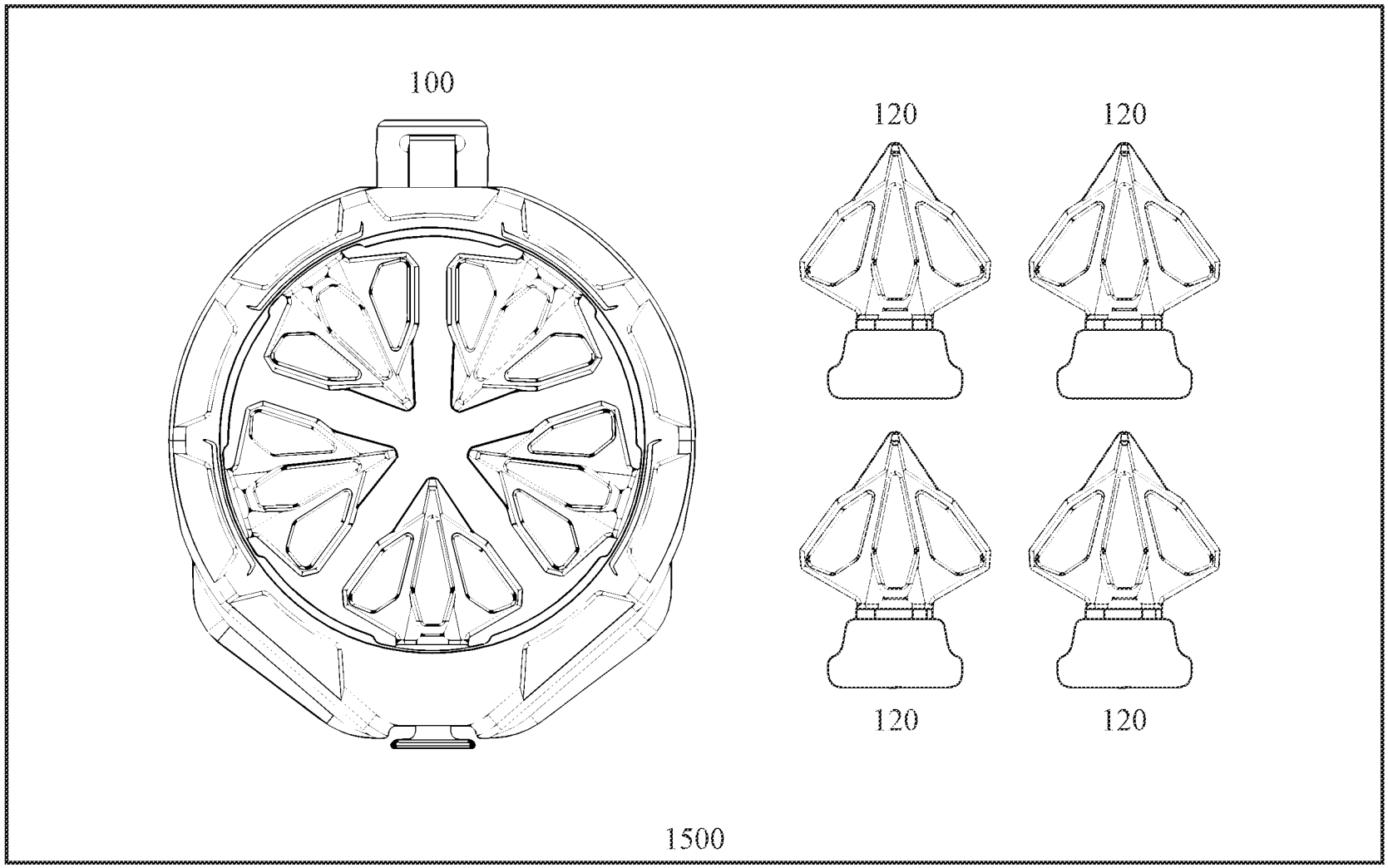
FIG. 15 illustrates a kit including the feeder cover of FIG. 1 and replacement fins.

FIG. 15 illustrates a top view of a feeder cover kit 1500. The feeder cover kit 1500 may include a feeder cover 100 and one or more replacement fins 120. The replacement fins 120 may be used to replace any lost or broken fins 120. Additionally, some feeder cover kits 1500 include two or more feeder covers 100. Thus, a user may replace a lost or broken feeder cover 100 or have multiple customized feeder covers 100. For example, in some cases, a user may anodize one or more feeder covers 100 with custom designs.

Overall, the feeder cover 100 allows a user to easily and effectively refill their loader 1205 with paintballs. The feeder cover 100 also allows users to easily repair, maintain, and customize their feeder cover 100.

Additional Embodiments

In embodiments of the present disclosure, a feeder cover for a paintball loader may be in accordance with any of the following clauses:

Clause 1. A feeder cover for a paintball loader, comprising:

an annular housing having a central opening centered on a central axis of the annular housing, the annular housing configured to be removably coupled to the paintball loader, the annular housing comprising:

a releasable latch configured to latch the annular housing to the paintball loader; and a plurality of fins removably coupled to the annular housing, each of the fins having a fin blade configured to at least partially extend into the central opening in a direction generally transverse to the central axis and cover at least a portion of the central opening, the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader.

Clause 2. The feeder cover of any preceding clause, wherein the spring-loaded hinge comprises a coil spring.

Clause 3. The feeder cover of any preceding clause, wherein the spring-loaded hinge allows movement of the fin blades relative to a proximal portion of the fins.

Clause 4. The feeder cover of any preceding clause, wherein the annular housing comprises a first annular portion and a second annular portion, the first and the second annular portions being coupleable to each other and together forming the annular housing, wherein a proximal portion of the fins is interposed between the first and second annular portions.

Clause 5. The feeder cover of clause 4, wherein the first and second annular portions together define slots that receive the proximal portions of the fins.

Clause 6. The feeder cover of any preceding clause, wherein the fins are made of aluminum.

Clause 7. The feeder cover of any preceding clause, wherein the plurality of fins is five fins.

Clause 8. The feeder cover of any preceding clause, wherein the fin blades have openings that allow air to pass therethrough.

Clause 9. The feeder cover of any preceding clause, wherein the fin blades have a stepped outer edge portion so that a gap between adjacent fin blades is smaller proximate an inner surface of the annular housing than proximate the central axis, which facilitates loading of paintballs into the paintball loader when traveling in the first direction while inhibiting paintballs travelling in the second direction from falling out of the paintball loader.

Clause 10. The feeder cover of claim of any preceding clause, wherein the releasable latch is configured to be received in a slot of the paintball loader.

Clause 11. The feeder cover of claim of any preceding clause, wherein the annular housing is configured to be removably coupled to the paintball loader via a hinge mechanism.

Clause 12. An assembly for storing paintballs, comprising:

a paintball loader; and a feeder cover configured to be removably coupled to the paintball loader, the feeder cover comprising:

an annular housing having a central opening centered on a central axis of the annular housing, the annular housing configured to be removably coupled to a hinge mechanism of the paintball loader, the annular housing comprising:

a front release configured to couple to the paintball loader and allow the annular housing to pivot relative to the paintball loader; and a plurality of fins removably coupled to the annular housing, each of the fins having a fin blade configured to at least partially extend into the central opening in a direction generally transverse to the central axis and cover at least a portion of the central opening, the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader, wherein the paintball loader is configured to receive and store paintballs passing through the feeder cover.

Clause 13. The assembly for storing paintballs of any preceding clause, wherein the spring-loaded hinge comprises a coil spring.

Clause 14. The assembly for storing paintballs of any preceding clause, wherein the spring-loaded hinge allows movement of the fin blades relative to a proximal portion of the fins.

Clause 15. The assembly for storing paintballs of any preceding clause, wherein the fin blades have a stepped outer edge portion so that a gap between adjacent fin blades is smaller proximate an inner surface of the annular housing than proximate the central axis, which facilitates loading of paintballs into the paintball loader when traveling in the first direction while inhibiting paintballs travelling in the second direction from falling out of the paintball loader.

Clause 16. The assembly for storing paintballs of any preceding clause, wherein the front release further comprises a clip configured to be clipped into a corresponding cavity of the paintball loader.

Clause 17. A feeder cover kit for a paintball loader, comprising:

a feeder cover comprising:

an annular housing having a central opening centered on a central axis of the annular housing, the annular housing configured to be removably coupled to the paintball loader, the annular housing comprising:

a releasable latch configured to latch the annular housing to the paintball loader;

a plurality of fins removably coupled to the annular housing, each of the fins having a fin blade configured to at least partially extend into the central opening in a direction generally transverse to the central axis and cover at least a portion of the central opening, the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader; and one or more replacement fins configured to be removably coupled to the annular housing to replace one or more of the plurality of fins.

Clause 18. The feeder cover kit of any preceding clause, wherein the annular housing comprises a first annular portion and a second annular portion, the first and the second annular portions being coupleable to each other and together forming the annular housing, wherein a proximal portion of the fins is interposed between the first and second annular portions.

Clause 19. The feeder cover kit of Clause 18, wherein the first and second annular portions together define slots that receive the proximal portions of the fins.

Clause 20. The feeder cover kit of claim 17, wherein the fins are made of aluminum.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A feeder cover for a paintball loader, comprising:

an annular housing having a central opening centered on a central axis of the annular housing, the annular housing configured to be removably coupled to the paintball loader, the annular housing comprising:

a releasable latch configured to latch the annular housing to the paintball loader; and a first annular portion and a second annular portion, the first annular portion and the second annular portion being coupleable to each other and together forming the annular housing, wherein the first annular portion and the second annular portion together define individual slots, each slot receiving a proximal portion of one fin of a plurality of fins, wherein the proximal portions of the fins are interposed between the first annular portion and the second annular portion; and the plurality of fins individually removably coupled to the annular housing, each of the fins having a fin blade configured to at least partially extend into the central opening in a direction generally transverse to the central axis and cover at least a portion of the central opening, each of the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader.

2. The feeder cover of claim 1, wherein the spring-loaded hinge comprises a coil spring.

3. The feeder cover of claim 2, wherein the spring-loaded hinge allows movement of the fin blades relative to the proximal portion of the fins.

4. The feeder cover of claim 1, wherein the fins are made of aluminum.

5. The feeder cover of claim 1, wherein the plurality of fins is five fins.

6. The feeder cover of claim 1, wherein the fin blades have openings that allow air to pass therethrough.

7. The feeder cover of claim 1, wherein the fin blades have a stepped outer edge portion so that a gap between adjacent fin blades is smaller proximate an inner surface of the annular housing than proximate the central axis, which facilitates loading of paintballs into the paintball loader when traveling in the first direction while inhibiting paintballs travelling in the second direction from falling out of the paintball loader.

8. The feeder cover of claim 1, wherein the releasable latch is configured to be received in a slot of the paintball loader.

9. The feeder cover of claim 1, wherein the annular housing is configured to be removably coupled to the paintball loader via a hinge mechanism.

10. An assembly for storing paintballs, comprising:

a paintball loader; and a feeder cover configured to be removably coupled to the paintball loader, the feeder cover comprising:

an annular housing having a central opening centered on a central axis of the annular housing, the annular housing configured to be removably coupled to a hinge mechanism of the paintball loader, the annular housing comprising:

a front release configured to couple to the paintball loader and allow the annular housing to pivot relative to the paintball loader; and a first annular portion and a second annular portion, the first annular portion and the second annular portion being coupleable to each other and together forming the annular housing, wherein the first annular portion and the second annular portion together define individual slots, each slot receiving a proximal portion of one fin of a plurality of fins, wherein the proximal portions of the fins are interposed between the first annular portion and second annular portion; and the plurality of fins individually removably coupled to the annular housing, each of the fins having a fin blade configured to at least partially extend into the central opening in a direction generally transverse to the central axis and cover at least a portion of the central opening, each of the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader, wherein the paintball loader is configured to receive and store paintballs passing through the feeder cover.

11. The assembly for storing paintballs of claim 10, wherein the spring-loaded hinge comprises a coil spring.

12. The assembly for storing paintballs of claim 11, wherein the spring-loaded hinge allows movement of the fin blades relative to the proximal portion of the fins.

13. The assembly for storing paintballs of claim 10, wherein the fin blades have a stepped outer edge portion so that a gap between adjacent fin blades is smaller proximate an inner surface of the annular housing than proximate the central axis, which facilitates loading of paintballs into the paintball loader when traveling in the first direction while inhibiting paintballs travelling in the second direction from falling out of the paintball loader.

14. The assembly for storing paintballs of claim 10, wherein the front release further comprises a clip configured to be clipped into a corresponding cavity of the paintball loader.

15. A feeder cover kit for a paintball loader, comprising:

a feeder cover comprising:

an annular housing having a central opening centered on a central axis of the annular housing, the annular housing configured to be removably coupled to the paintball loader, the annular housing comprising:

a releasable latch configured to latch the annular housing to the paintball loader; and a plurality of individual slots arranged circumferentially and spaced from each other;

a plurality of fins individually removably coupled to the annular housing, each of the fins having a proximal portion and a fin blade, wherein the fin blade is configured to at least partially extend into the central opening in a direction generally transverse to the central axis and cover at least a portion of the central opening, and wherein the proximal portion is received into one of the individual slots of the annular housing, each of the fins comprising a spring-loaded hinge configured to allow the fin blades to move relative to the annular housing to allow paintballs traveling in a first direction to pass through the central opening of the annular housing and into the paintball loader, and configured to inhibit paintballs traveling in a second direction opposite the first direction from passing through the central opening and out of the paintball loader; and one or more replacement fins configured to be removably coupled to the annular housing to replace one or more of the plurality of fins.

16. The feeder cover kit of claim 15, wherein the annular housing comprises a first annular portion and a second annular portion, the first annular portion and the second annular portion being coupleable to each other and together forming the annular housing, wherein the proximal portion of the fins is interposed between the first annular portion and second annular portion.

17. The feeder cover kit of claim 16, wherein the first annular portion and second annular portion together define the individual slots that receive the proximal portions of the fins.

18. The feeder cover kit of claim 15, wherein the fins are made of aluminum.

* * * * *